United States Patent [19]

Malerba et al.

[11] 4,151,500

[45] Apr. 24, 1979

[54] LINE OUTPUT TRANSFORMER

[75] Inventors: Mario Malerba; Massimo Galeotti, both of Turin, Italy

[73] Assignee: Indesit Industria Eletrodomestici Italiana S.p.A., Turin, Italy

[21] Appl. No.: 849,927

[22] Filed: Nov. 9, 1977

[30] Foreign Application Priority Data

Nov. 9, 1976 [IT] Italy ..... 69672 A/76

[51] Int. Cl.[2] ..... H01F 15/10; H01F 27/30

[52] U.S. Cl. ..... 336/185; 336/192; 336/198

[58] Field of Search ..... 336/198, 208, 192, 185, 336/180; 310/71

[56] References Cited

U.S. PATENT DOCUMENTS

| | | | |
|---|---|---|---|
| 3,117,294 | 1/1964 | Muszynski et al. | 336/198 X |
| 3,131,371 | 4/1964 | Brekke et al. | 336/198 X |
| 3,661,342 | 5/1972 | Sears | 336/208 X |
| 3,848,208 | 11/1974 | Dawson et al. | 336/208 X |
| 3,947,795 | 3/1976 | Donnelly et al. | 336/198 X |
| 4,039,924 | 8/1977 | Scales et al. | 36/185 X |

FOREIGN PATENT DOCUMENTS

| | | | |
|---|---|---|---|
| 2326769 | 4/1977 | France | 336/198 |
| 150315 | 6/1955 | Sweden | 336/198 |

*Primary Examiner*—Thomas J. Kozma

*Attorney, Agent, or Firm*—Lerner, David, Littenberg & Samuel

[57] ABSTRACT

A line output transformer for a television receiver has a plurality of windings which surround a ferromagnetic core and are wound around an insulating support. The support has a plurality of grooves for receiving the respective windings, the defining wall of at least one of the grooves being provided with a slot intended to guide the starting end of a winding to the bottom of the groove and to inhibit contact between the starting end and subsequent turns wound in the groove.

5 Claims, 8 Drawing Figures

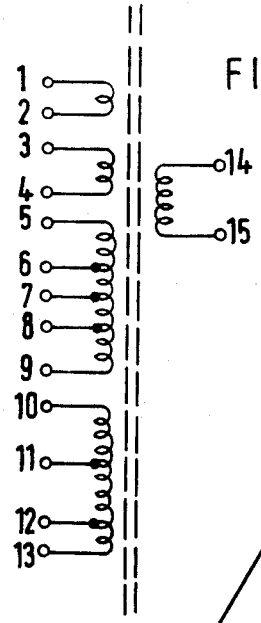
FIG. 1.
FIG. 2.
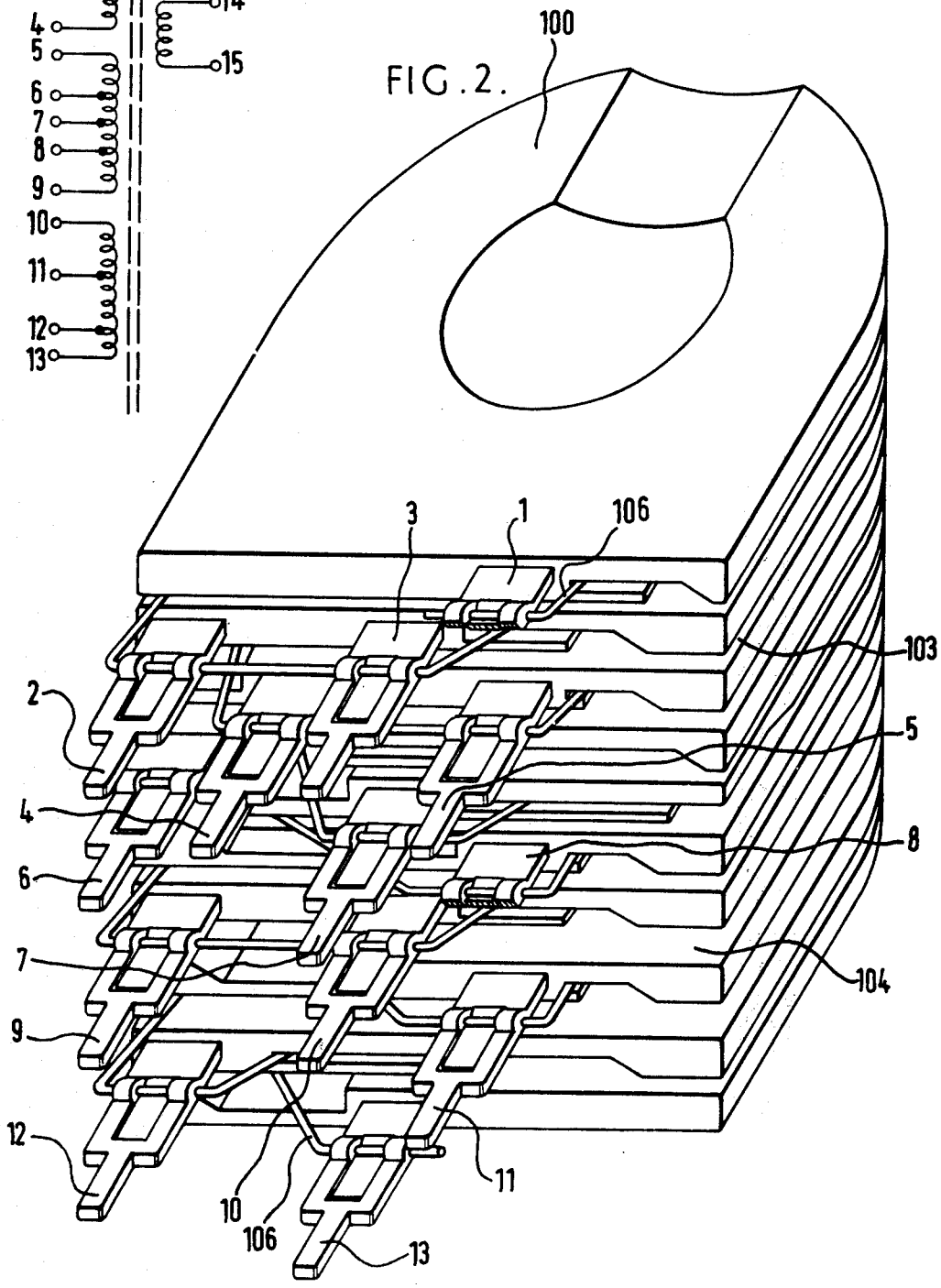

LINE OUTPUT TRANSFORMER

BACKGROUND OF THE INVENTION

The present invention relates to a line output transformer for a television set, including a number of windings, for connecting the line output stage to the horizontal deflection coil(s) and for supplying voltage to other auxiliary circuits, the transformer having at least a ferromagnetic core and an insulating support for the said windings, the said support being designed to accommodate a number of metal terminals for connecting the said windings to the remaining circuitry of the set.

The current design practice in modern television sets is to use the line output stage as a voltage source for supplying or controlling many if not all the circuits of the set. A consequence of this practice is that the line output transformer (or extra-high tension (EHT) transformer as it is also called, as it also generates the acceleration voltage for the C.R.T. anode) has a number of different windings, some isolated and others connected in series.

The current practice is to wind the windings onto two separate supports to form two coils of which one, termed the primary coil, contains all the windings with the exception of the EHT winding and the other is called the EHT coil, or tertiary coil, as the primary coil contains the primary winding connected to the line output stage and various secondary windings.

The two coils, at least in Europe, are usually arranged parallel to one another on two opposite parallel branches of the ferromagnetic core.

The primary coil, which has many output terminals (usually more than ten), is wound in one of the following two ways, namely:

1. Ten or fifteen coils at a time are wound on a multi-spindle winding machine and sheets of plastics (polyester or polycarbonate) material are inserted between one layer and the next. The multiple windings are then cut to obtain the individual windings of the primary coil; and 2. a single primary coil is wound at a time.

The first method is quick and there are programmable, semi-automatic machines which stop automatically after each winding or part winding has been wound to insert the insulating material between one layer and the next. The start and end of each winding must be held in place by the operator with adhesive tape.

Once the primary coils are wound and separated from one another:

the start and end of each winding of each coil must be pulled out using a crochet hook which is a delicate, tedious operation, and the primary coil must be mounted on the coil support carrying the terminals and the ends of the winding must be wrapped around and soldered to the terminals.

In the second method, each coil is wound directly on the support but the method is much slower. At each stop, the operator must tape down the wire and wind the ends around the appropriate terminals to which they are subsequently soldered.

It is more difficult, using the second method, to insert the insulating sheets between layers automatically.

It is also known (see for instance U.S. Pat. Nos. 2,982,888 and 3,644,986) to wind transformers and more particularly television transformers on grooved coil supports so that the individual windings are insulated one from the other; but with such a method there is a problem as to how to insulate inside a groove the starting end of a winding from subsequent turns and how to make in a simple and inexpensive way the connections of the ends of the windings and the remainder of the circuit.

BRIEF DESCRIPTION OF THE INVENTION

The present invention seeks to mitigate the problems encountered in the above prior art winding methods.

According to the present invention, there is provided a line output transformer for a television receiver having a plurality of windings for connection to the line output stage and the deflection coil(s) of the receiver and for supplying voltage to auxiliary circuits of the receiver, the transformer further comprising a ferromagnetic core and an insulating support for at least some of the windings, the said support having a plurality of terminals connected to the ends of the windings and having a plurality of grooves, defined by insulating walls, for receiving the windings and insulating the windings for one another, a wall of at least one of the said grooves having a slot operative during winding to guide the starting end of a winding to the bottom of the groove and serving to inhibit contact between the said starting end and subsequent turns wound in the groove.

BRIEF DESCRIPTION OF THE FIGURES

The invention will now be described, by way of example, with reference to the accompanying drawings, in which:

FIG. 1 shows a diagrammatic representation of a line output transformer for a 24 inches black and white television set;

FIG. 2 shows a perspective view of the primary coil of the transformer of FIG. 1 constructed in accordance with the invention.

DETAILED DESCRIPTION OF THE INVENTION AND THE PREFERRED EMBODIMENTS THEREOF

As shown in FIG. 1 a line output transformer for a 24 inches television set, taken as an example, consists of a set of ten windings, some isolated and others connected in series.

Fifteen terminals are therefore required which are marked 1 to 15 in FIG. 1. As can be seen, the windings connected to terminals 1-2, 3-4 and 14-15 are isolated while those connected to terminals 5-6-7-8-9 are connected in series, as are the windings connected to terminals 10-11-12-13. Table I found hereinbelow sets out the circuit connection of these fifteen terminals.

Figure 3A:
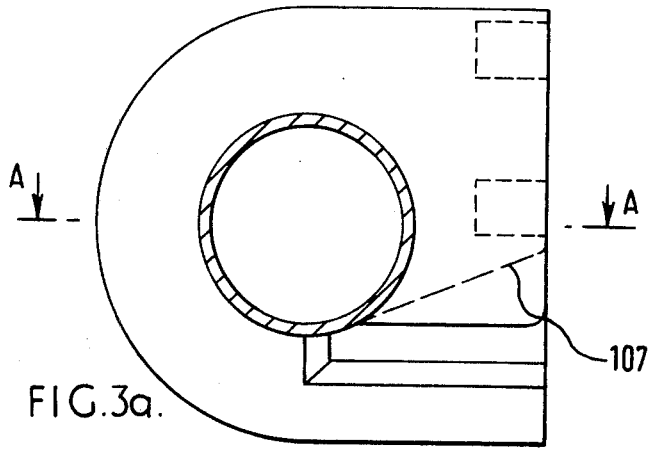
FIGS. 3*a*, 3*b* and 3*c* show three sections of support of the primary coil of FIG. 2 form before the terminals are inserted and the wire wound.
Figure 3B:
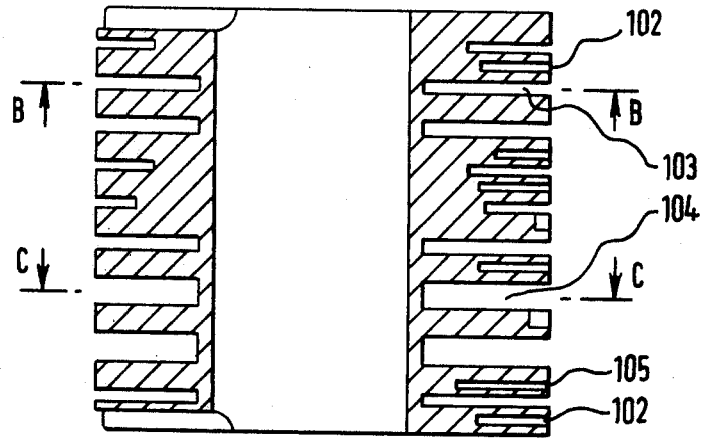
Figure 3C:
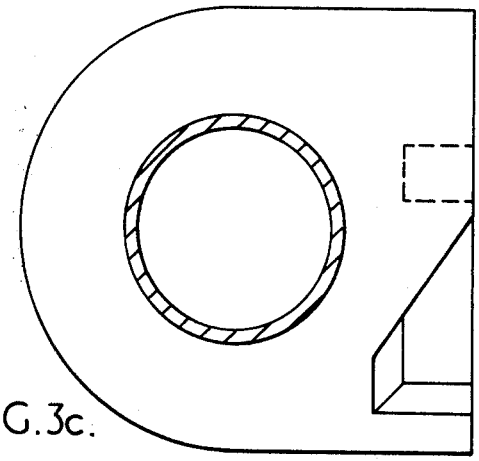

The windings connected to terminals 1 to 13 are all wound on a single support having nine grooves which is herein termed the primary coil form and is shown in FIGS. 2 and 3. The support is made of suitable plastics material, such as polycarbonate, and may, if necessary, be reinforced with glass fibre. FIG. 2 shows the primary coil form complete with the terminals and windings as seen from the side carrying the terminals. FIGS. 3*a* to 3c show three sections of the coil form before assembling the terminals and windings.

Figure 5:
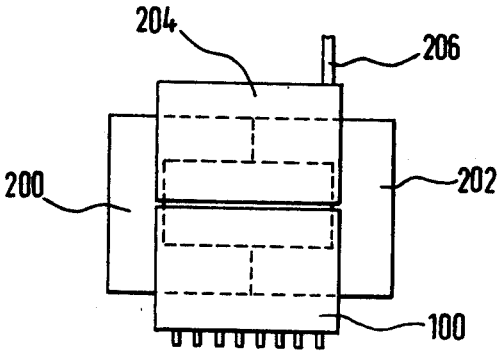
FIG. 5 is a diagrammatic view of a complete transformer showing a primary winding and and EHT winding mouned on a ferromagnetic core.

As shown in FIG. 5, the complete EHT transformer comprises a primary coil 100 and also an EHT coil, 204, which consists of the winding connected to terminals 14 and 15 wound using known methods on a second support or coil form. One of the terminals of the EHT winding is connected to a terminal of the primary coil whilst the other is connected to the EHT lead designated 206 in FIG. 5. The ferromagnetic core comprises of two U-shaped cores 200 and 202 of a type currently used and available (Siemens catalogue U 56/28/16).

Figure 4A:
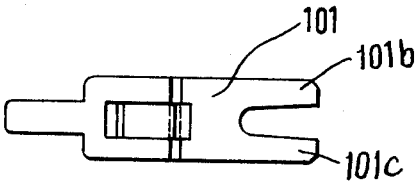
FIGS 4*a* and 4*b* show a plan view and an end view respectively, of a connection terminal.
Figure 4B:
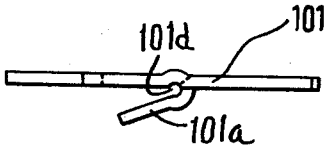

FIG. 4*a* shows a terminal 101 before it is inserted into the primary coil form. The terminal is made of plate (tin-plated) with a stamped out tab 101*a* to which the winding wire is connected and having a forked end with arms 101*b*, 101*c*, which are forced into a slot 102 (FIG. 3B) in the primary coil form. The terminal 101 and the tab 101*a* have oppositely curved notches which together define a channel 101*d* for receiving the wire, the channel being best seen in FIG. 4*b*. The entrance to the channel is narrower than the wire diameter so that once inserted into the channel between the tab and the rest of the terminal the wire is gripped against unintentional release. When the tab 101*a* is clamped or folded down towards the main portion of terminal 101 the wire is prevented from escape.

With reference to FIG. 2, the windings are wound as follows. First the wire 106 is passed over terminal 1 (this terminal and terminal 8 are both shown partly cut away to show the wire route clearly) between the terminal and tab (in FIG. 2 the tabs are drawn closed as they are clamped after winding to keep the wire in place); the wire is then inserted into the first of the nine grooves on the primary coil form. Each groove has a slot, the slot of the first groove being seen clearly in FIG. 2 and a slot being shown in cross section in FIG. 3A and designated 105. The wire is threaded into the slot and wound round the groove the required number of turns (six in the case of the first winding: see Table II). Subsequent turns wound in the groove do not come into contact with the wire from terminal 1 which is protected inside the aforementioned slot against chafing. After six turns have been wound, the wire is passed over terminal 2, then terminal3 (FIG.2) and is inserted into the second groove (103) where, this time, it is wound 31 turns (Table II). The second groove (103) also has a protective slot for the start of the winding. The latter slot can also be seen in FIG. 3A whre the dotted line 107 shows the bottom of the slot which slopes to guide the wire on its way down). The wire is then pulled up, passed over terminal 4 and so on up to terminal 13 which marks the end of the winding operation.

The tabs on the terminals are now clamped to keep the wire in position.

The wires between terminals 2-3, 4-5 and 9-10 are subsequently cut to isolate the various winding parts from one another.

FIG. 3C shows part of the seventh groove (104) and the sloping plane for guiding the wire up to terminal 11.

If necessary, the wires are now soldered to the terminals to ensure perfect contact after which the two coil forms (primary and EHT) are assembled on the core. A terminal (14) of the EHT winding is connected to a suitable terminal (e.g. terminal 4) on the primary form and the transformer is ready for inserting on to the television printed circuit where the 13 primary terminals are inserted into the same number of holes and wave- or dip-soldered, as known per se.

The advantages of the transformer according to the present invention will be clearly seen from the description given. The main ones can be summed up as follows:

fully-automatic winding of the primary coil in a single winding operation;

safe insulation of windings;

safe insulation between the start of each single windings and the following turns.

TABLE I

| Terminal | Connected to |
|---|---|
| 1 | Line output transistor bias circuit |
| 2 | Line output transistor bias circuit |
| 3 | Sound amplifier supply |
| 4 | Ground |
| 5 | Frame output stage supply |
| 6 | Miscellaneous services |
| 7 | Ground |
| 8 | CRT heater filament |
| 9 | Video amplifier supply |
| 10 | Half horizontal deflection coil |
| 11 | Tuning compensation winding |
| 12 | Half horizontal deflection coil |
| 13 | Line output transistor collector |
| 14 | Ground |
| 15 | EHT rectifier |

TABLE II

| Winding | Wire Φ | Turns |
|---|---|---|
| 1-2 | 0.45 | 6 |
| 3-4 | 0.45 | 31 |
| 5-6 | 0.45 | 28 |
| 6-7 | 0.45 | 6 |
| 7-8 | 0.45 | 3 |
| 8-9 | 0.45 | 25 |
| 10-11 | 0.45 | 60 |
| 11-12 | 0.45 | 60 |
| 12-13 | 0.45 | 14 |
| 14-15 | 0.10 | 1750 |

We claim:

1. A line output transformer for a television receiver having a plurality of windings for connection to the line output stage and the deflection coil(s) of the receiver and for supplying voltage to auxiliary circuits of the receiver, the transformer further comprising a ferromagnetic core and an insulating support for at least some of the windings, the said support having a plurality of terminals connected to the ends of the windings and having a plurality of grooves, defined by insulating walls, for receiving the windings and insulating the windings from one another, a wall of at least one of the said grooves having a slot operative during winding to guide the starting end of a winding to the bottom of the groove and serving to inhibit contact between the said starting end and subsequent turns wound in the groove, wherein the said terminals are supported in the walls defining the grooves and are all arranged on the same side of the support whereby the ends of the terminals may be soldered onto a substantially flat printed circuit board, and wherein the said terminals each include an elongated tab stamped out of the terminals, the inner end of the tabs and the portion of the terminals adjacent to the inner end of the tab having oppositely curved notches whereby to enable the winding wire to be drawn across the terminals in the direction of winding without bending and snapped into said notches to be gripped therebetween during winding, the tabs being capable of being clamped down after the windings have been wound to prevent release of the wire so as to enable a plurality of the windings to be wound consecutively without breaking the winding wire.

2. A transformer according to claim 1, wherein the windings comprise an EHT winding which is wound on a separate support from the remaining windings, the two supports being mounted on a common ferromagnetic core.

3. A line output transformer for a television receiver having a plurality of windings for connection to the line output stage and a deflection coil(s) of the receiver and for supplying voltage to auxiliary cirlcuits of the receiver, the transformer further comprising a ferromagnetic core and an insulating support for at least some of the windings, the said support having a plurality of terminals connected to the ends of the windings and having a plurality of grooves, defined by insulating walls, for receiving the windings and insulating the windings from one another, the walls of selective ones of said grooves each having a slot operative during winding to guide the starting end of a winding to the bottom of the groove and serving to inhibit contact between the said starting end and subsequent turns of the winding wound in the groove;

at least one terminal being supported in each of the walls defining the grooves and said terminals all being arranged on the same side of the support, whereby the ends of the terminals may be soldered onto a substantially flat printed circuit board;

at least one terminal being arranged in each wall adjacent to the slot in the wall, at least one of the walls intermediate the end walls of said support having the winding from the groove adjacent to one side of the wall passing through the terminal in that wall and extending into the slot in said intermediate wall.

4. The transformer according to claim 3 wherein at least one of said intermediaate walls has a second terminal spaced from the terminal adjacent to the slot in said intermediate wall to receive the winding of the groove arranged on one side of the wall, said winding extending between and joined to both of the terminals in said intermediate wall.

5. The transformer according to claim 3 wherein at least two of said intermediate walls each have a second terminal spaced from the terminal adjacent to the slot in its associated intermediate walls to receive the winding of the groove arranged on one side of said wall, which winding extends between both of the terminals arranged in the intermediate wall, wherein the portion of the winding extending between the two terminals in one of said intermediate walls may be severed upon completion of the winding operation.

* * * * *